United States Patent [19]

Paulson

[11] 4,137,844

[45] Feb. 6, 1979

[54] PERFECTOR PRINTER PRESS

[76] Inventor: Harold E. Paulson, 5369 Vernon Lake Dr., Dunwoody, Ga. 30338

[21] Appl. No.: 812,053

[22] Filed: Jul. 1, 1977

Related U.S. Application Data

[63] Continuation-in-part of Ser. No. 749,039, Dec. 9, 1976, abandoned.

[51] Int. Cl.[2] ..... B41F 5/12; B41F 7/12

[52] U.S. Cl. ..... 101/218; 101/229; 101/137; 101/175; 101/177

[58] Field of Search ..... 101/216, 217, 218, 229, 101/230, 231, 137, 425, 232, 174, 175–177, 374

[56] References Cited

U.S. PATENT DOCUMENTS

| | | | |
|---|---|---|---|
| 1,238,325 | 8/1917 | Parmelee | 101/218 |
| 1,307,007 | 6/1919 | Hanser | 101/175 |
| 1,517,969 | 12/1924 | Evans | 101/218 |
| 1,933,887 | 11/1933 | Woods | 101/374 |
| 2,387,750 | 10/1945 | Davidson | 101/218 |
| 2,874,636 | 2/1959 | Royer et al. | 101/218 |
| 2,909,117 | 10/1959 | Crissy | 101/137 |
| 2,981,181 | 4/1961 | Levien | 101/217 |
| 3,398,681 | 8/1968 | Hirose | 101/216 |
| 3,690,253 | 9/1972 | Dreyer | 101/217 |
| 3,769,910 | 11/1973 | Heimlicher et al. | 101/218 |
| 3,829,083 | 8/1974 | Shinna et al. | 271/4 |

*Primary Examiner*—William Pieprz
*Attorney, Agent, or Firm*—Neil B. Schulte

[57] ABSTRACT

A perfector printing press having a full size impression cylinder with a blanket thereon between the perfector roll and the plate roll so that printing is not done on the smaller radius perfector roller. The perfector is easier to reach for cleaning and changing and the quality of the printing is improved. The perfector may be spring loaded to prevent jam ups and pivoted about the impression cylinder for easier access.

5 Claims, 18 Drawing Figures

PERFECTOR PRINTER PRESS

BACKGROUND OF THE INVENTION

This application is a continuation-in-part of applicant's prior copending application Ser. No. 749,039, filed Dec. 9, 1976, now abandoned.

Prior art perfector presses typically utilize a perfector cylinder as an impression cylinder mounted against the underside of a plate or blanket cylinder to pickup and transfer images to the underside of stock passing between the perfector cylinder and the plate or blanket cylinder. The difficulty in this is that the smaller radius perfector roll forms a poor printing surface being in contact for a shorter period of time and being inherently less rigid. Also the perfector roll is hard to reach and service because it must be placed under the press in the proper position to pass stock through horizontally and further must be securely mounted to resist the pressures of stock passing between the rolls. Accordingly, the perfector roll is hard to remove. But removal is made more necessary by frequent jam ups caused by stock getting jammed between the solidly mounted perfector roll and the contacting plate or blanket roll.

Even if one does not wish to print both sides of the stock and decides to use the press just as a simple one side printing press, he still must leave the perfector roller in place as an impression surface and, thus, suffer all of the above problems of poor printing quality, difficult access, and frequent jam ups. Such jam ups can generate enough pressure to break the machine in some cases. My invention avoids these prior art disadvantages with the new and novel structure described hereinafter.

SUMMARY OF THE INVENTION

Briefly, the present invention contemplates an intermediate full size impression cylinder between the perfector roll and the regular blanket cylinder. This impression cylinder assures high quality printing because of its greater size and rigidity and permits conventional high quality one side printing even when no perfector roll is present.

The perfector roll itself can now be shifted about the intermediate full size impression cylinder to a position which affords easy access because the perfector is not being used as an impression surface and therefore need not be located to accomodate the horizontally moving stock. Further novel structure is also now possible in that the perfector roll can be automatically disengaged, as in one embodiment herein, or spring loaded, or even pivoted about the full size impression cylinder. All of this is possible since the perfector pressure has been made less critical by eliminating its use as an impression cylinder.

Thus, it may be seen that it is an object of my invention to provide a press with an easily accessible perfector roll so that different size perfector rolls may be readily installed and cleaned. It is a further object of my invention to provide mechanisms to retract the perfector roll from the impression cylinders so as to prevent jam ups. The main object is an improved perfector press providing higher quality printing on either one side or both sides with multiple color capability. Further objects and advantages will become apparent from the following description and drawings.

DESCRIPTION OF THE PREFERRED EMBODIMENT

Figure 1:
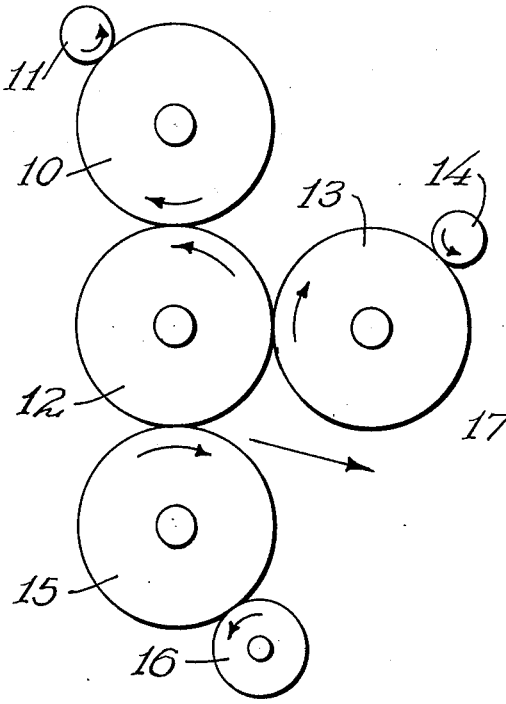
FIG. 1 is a diagrammatic view of the rollers in the printing press showing the general arrangement thereof.

Referring to FIG. 1, a plate cylinder 10 carries a plate about its circumference. Plate cylinder 10 is inked by a series of inking rolls, one of which is indicated at 11. Plate cylinder 10 applies one image to the surface of a blanket cylinder 12 in an area of up to one-half the circumference of the blanket cylinder 12 for direct printing on the front side of the stock. A second image is transferred to the remaining area of the blanket cylinder 12 for transfer to the back side of the stock. Other colors may also be applied to blanket cylinder 12 by another plate cylinder 13 which is provided with ink rollers 14.

Cylinder 12 prints on the front surface of the product as it passes through during one-half the rotation of cylinder 12. During the remaining half of the rotation, blanket cylinder 12 contacts an impression roller 15 and transfers the second image thereto. A blanket is provided on part or all of impression roller 15 so as to pick up the transfer image.

A perfector roller 16 of one-half the diameter of the impression roller 15 is positioned to take the second image from one-half the circumference of impression roller 15 and return it to the other one-half of the circumference thereof. Shifting the image from one half of impression roller 15 to the other half thereof puts the image in opposed relation to the first image printed on the upper surface of the stock by blanket cylinder 12. As a result, both sides of the stock are printed simultaneously as the stock passes between the impression cylinder 15 and blanket cylinder 12.

Figure 2:
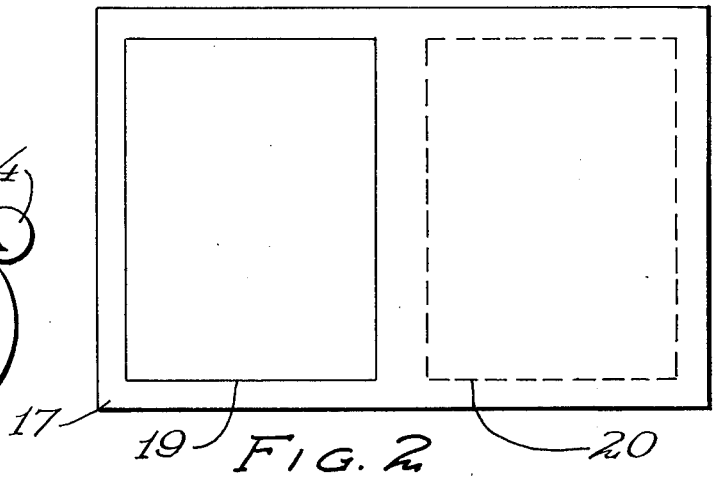
FIG. 2 is a diagrammatic plan of the surface of the blanket cylinder in FIG. 1 showing the area used to print directly on the stock, and the area used to transfer an image to the impression cylinder for printing on the back of the stock.
Figure 3:
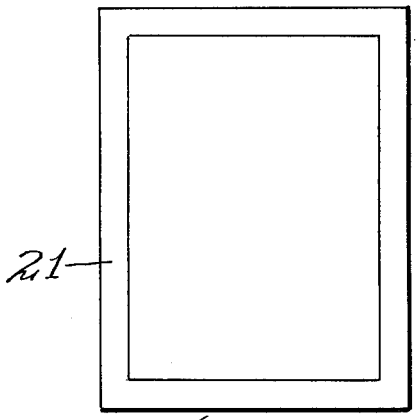
FIG. 3 is a diagrammatic view of the surface of the perfector cylinder of FIG. 1 showing the relationship of its area to that of the blanket cylinder.

FIG. 2 of the drawings diagrammatically illustrates the blanket cylinder 12 surface area 17. The area defined by solid line 19 indicates the printing area for the first image while the area 20 defined by dashed lines indicates the transfer or second image area. Transfer area 20 transfers the image to impression cylinder 15, and the perfector roller 16 transfers the image from one-half the circumference of impression cylinder 15 to the other half. As seen in FIG. 3 the area 21 of the perfector roller 16 is one-half the length of the area on impression cylinder 15 and blanket cylinder 12, the impression and blanket cylinders being of similar diameter.

Figure 4:
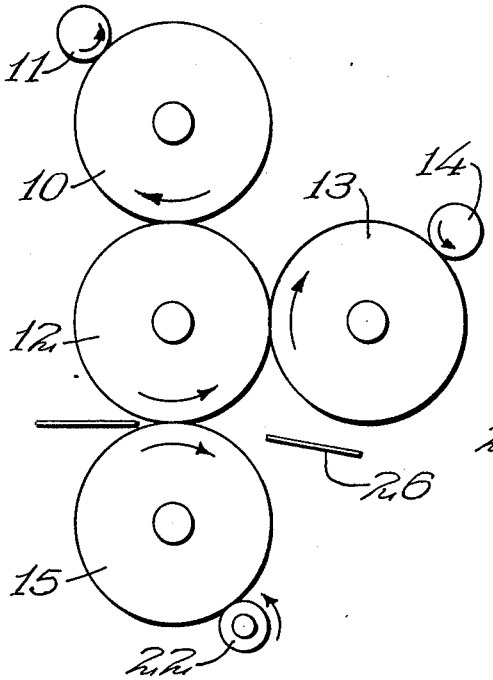
FIG. 4 is a diagrammatic view of the rollers with a perfector of reduced size.
Figure 5:
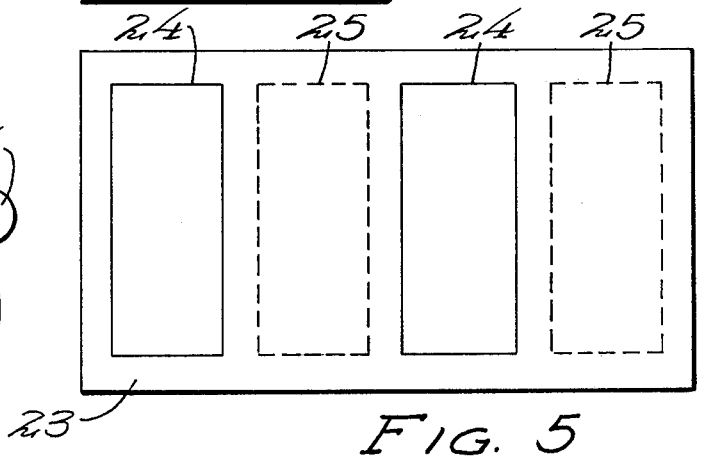
FIG. 5 is a diagrammatic view of the surface of the blanket cylinder of FIG. 4 showing in solid line the areas of direct printing and in dashed outline the areas which are transferred to the back of the stock.
Figure 6:
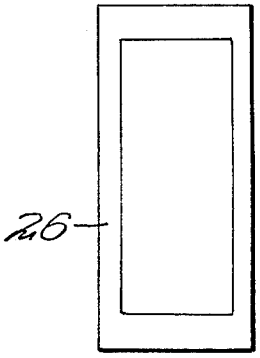
FIG. 6 is a diagrammatic view of the perfector surface area of FIG. 4.
Figure 7:
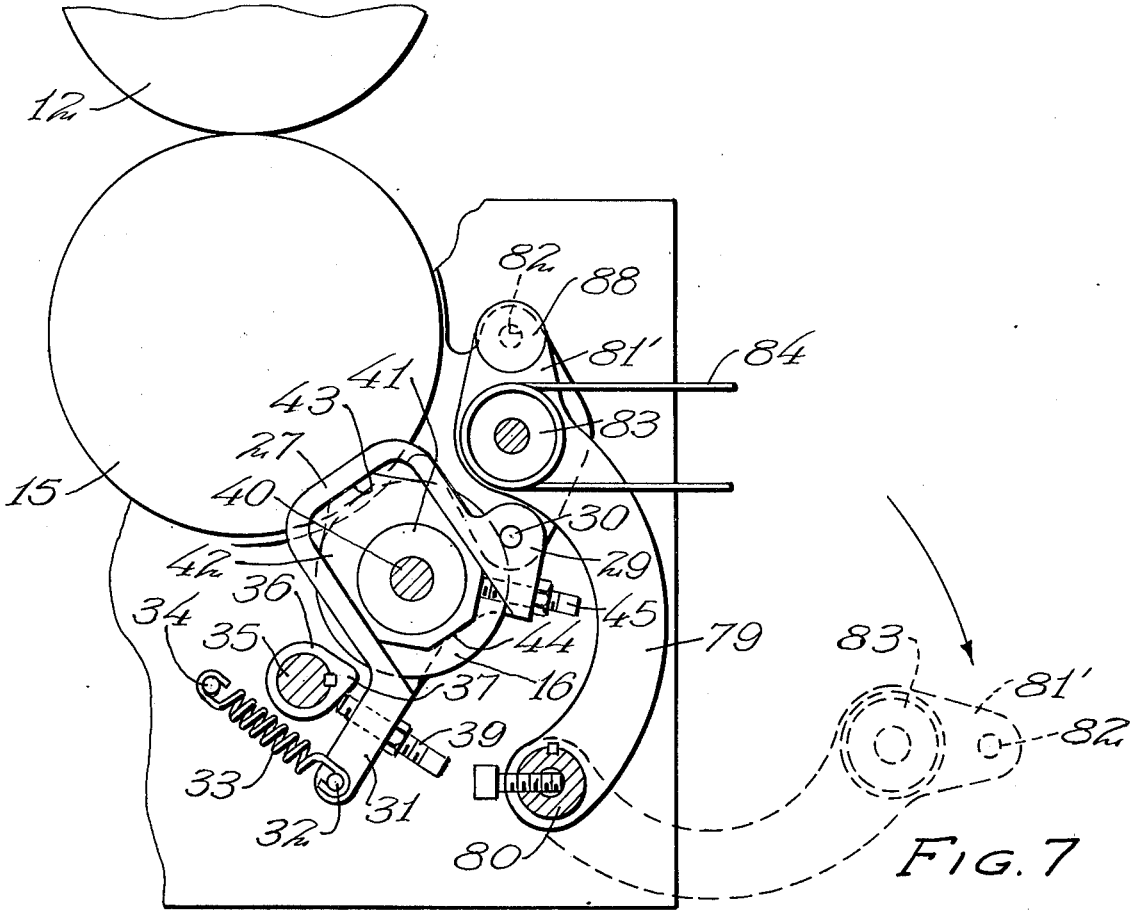
FIG. 7 is a detail view of a disengaging mechanism for the perfector cylinder.

If it is desirable to print smaller objects during each revolution of the blanket and impression cylinders, the diameter of the perfector roller may be cut in two as shown by roller 22 in FIG. 4. FIG. 5 illustrates diagrammatically a blanket roller area 23 having two first image areas 24 and two second image areas 25. FIG. 6 indicates that the area of sheet 26 is one-fourth the length of the area 23. In such a case, the perfector roller 22 rotates four times during each rotation of impression cylinder 15.

In the arrangements of FIGS. 1 and 4 a full diameter impression cylinder 15 is inserted between blanket roller 12 and perfectors 16 or 22. The larger radius impression roller 15 provides a much better printing surface than the perfector roller, coming into contact for a longer time and over a longer distance. Also the larger impression roller is much more rigid and can thus bear against blanket roller 12 more firmly and more evenly along its length. Furthermore, the exit angle of the stock, as shown by sheet 26 in FIG. 4, is determined by rollers 12 and 15 so that perfectors 16 and 22 are free to be moved out from under the press to a more accessible position as shown in the drawings. In the prior art one had to accept strange exit angles or a buried perfector. Since different size perfectors are routinely used and cleaned, access is all important to avoid down time in an expensive machine.

With the present invention one can switch to single side printing simply by disengaging the perfector which is not needed as an impression surface. Also the perfector roll does not require a critical pressure of bear against its companion since it's not used for impressions and therefore the perfector can be disengaged automatically by a variety of mechanisms as explained hereinafter.

FIGS. 7, 7A, 8, 9, and 10 show perfector disengaging means. A bracket 27 is milled out at 43 to form a U-shaped cup holding a bearing support 44. Bracket 27 includes a projecting ear 29 through which a pivot pin 30 extends. An arm 31 extends from the other side of the bracket 27 and is connected at 32 to a spring 33 which is in turn secured to the frame side at 34. A cam shaft 35 extends between the frame sides and supports (at each side) cams 36 which have projections 37 engageable with a set screw 39 extending through the arm 31. Upon rotation of the cam shaft 35 through a short angular distance, the arm 31 is moved from the position shown in FIG. 7 to the position shown in FIG. 8. The movement of the bracket 27 acts to disengage the perfector roller 16 from cylinder 15. The perfector roller support shaft 40 is supported in a bearing 41 mounted on bearing support 44 in U-shaped bracket 27. A set screw 45 holds the bearing support 44 in position.

Since perfector roller 16 is held against impression roller 15 by spring 33, any jammed materials that enter the space therebetween will not jam up or break the press. Roller 16 moves away automatically under the action of spring 33 to accomodate any jams. This is, of course, only possible as a result of the present invention's elimination of the use of the perfector roller as an impression surface. If the perfector were an impression roller it would have to be solidly mounted to maintain the proper impression pressure.

Figure 17:
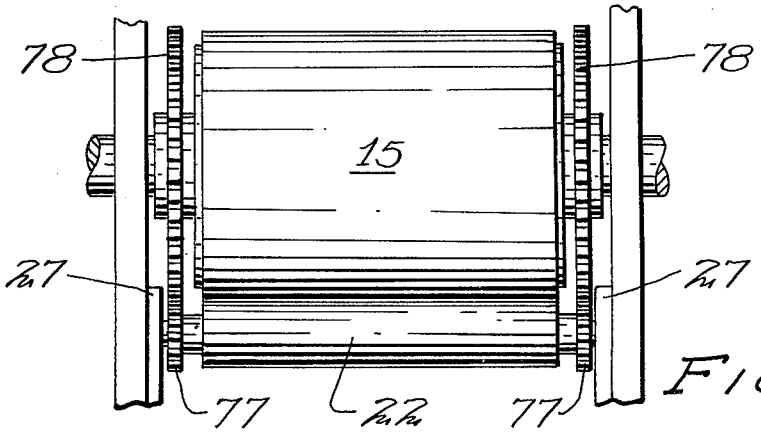
FIG. 17 is an elevational view of the perfector and impression cylinders with gears at both ends to provide a smooth drive.

With a spring mounted perfector roller it has been found desirable to use drive gears at both ends of the roller as shown in FIG. 17. This provides a smooth drive across the full length of the perfector roller and eliminates any gear backlash which could smear the images.

Figure 11:
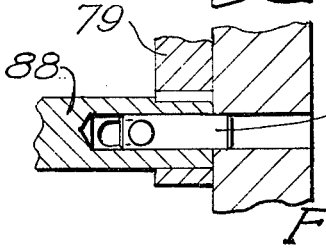
FIG. 11 shows a mechanism to disengage the conveyor drive.
Figure 7A:
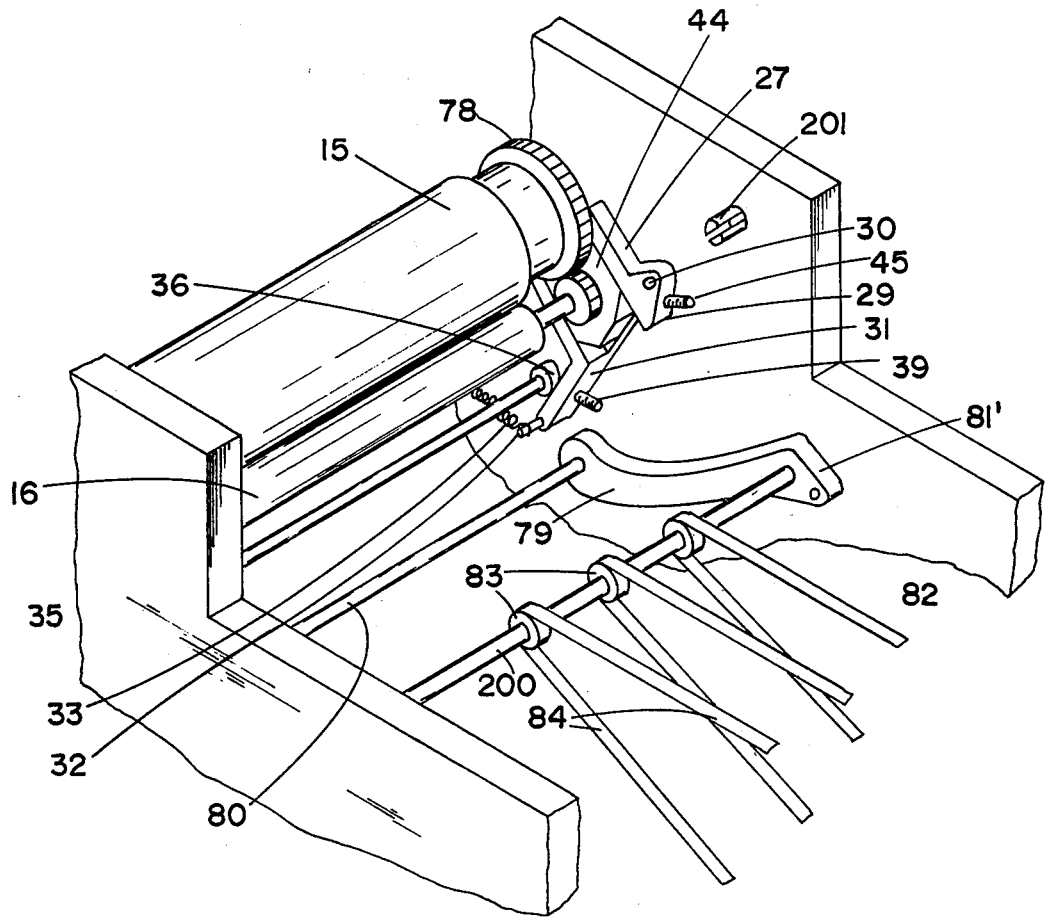
FIG. 7A is a perspective view of the mechanism of FIG. 7.
Figure 8:
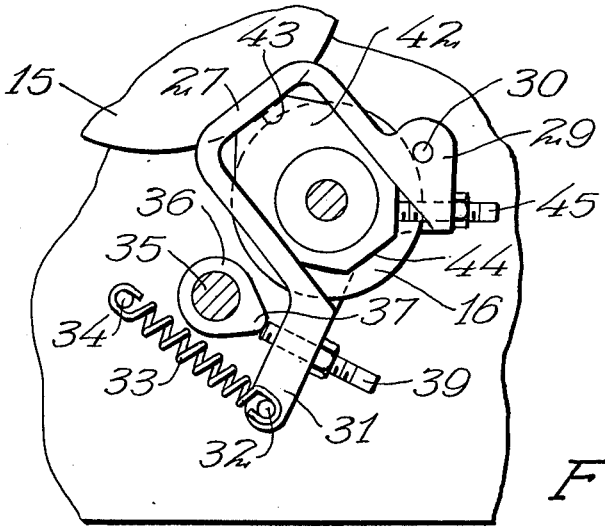
FIG. 8 is a view similar to FIG. 7 showing the perfector roller out of contact with the impression roller.

Stock is carried out of the press on a conveyor formed from several belts 84 carried on rollers 83 on a shaft 200. A pair of opposed arms 79 are pivotally mounted on a shaft 80 and are provided with apertures 82 to accomodate a pin 88 so as to hold the coneyor in an upright or closed position. As shown in FIG. 11, a pin 81 in the side frame slides into pin 88 to hold the arms 79 upright as shown by solid lines in FIG. 7. In this position conveyor support shaft 200 engages a slotted stub drive shaft 201 in the frame side as shown in FIG. 7A.

Figure 9:
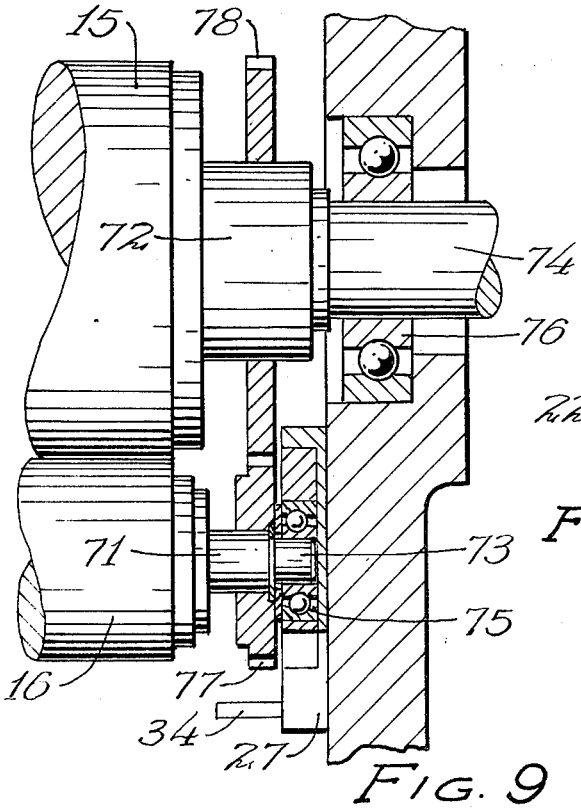
FIG. 9 is a sectional view through a portion of the printing press frame showing the impression cylinder, the perfector cylinder, and the connecting gearing.
Figure 10:
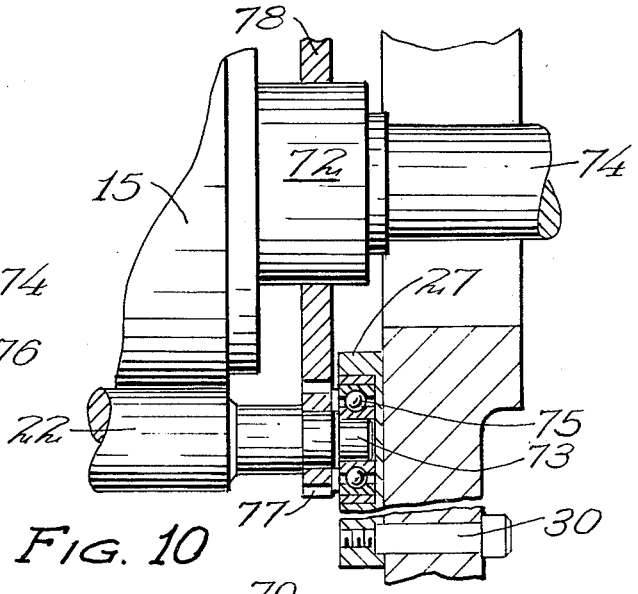
FIG. 10 is a view similar to FIG. 9 but in which a smaller diameter perfector roller is used.

As is usual in presses of this type, the cylinders are provided with extensions 71 and 72 such as shown in FIGS. 9 and 10. These extensions include reduced diameter portions 73 and 74 which are mounted in ball bearings 75 and 76 respectively and carried in bearing 41 and the frame respectively. As is usual, gears such as 77 and 78 at the ends of the cylinder shafts connect the various cylinders for operation in unison.

Figure 12:
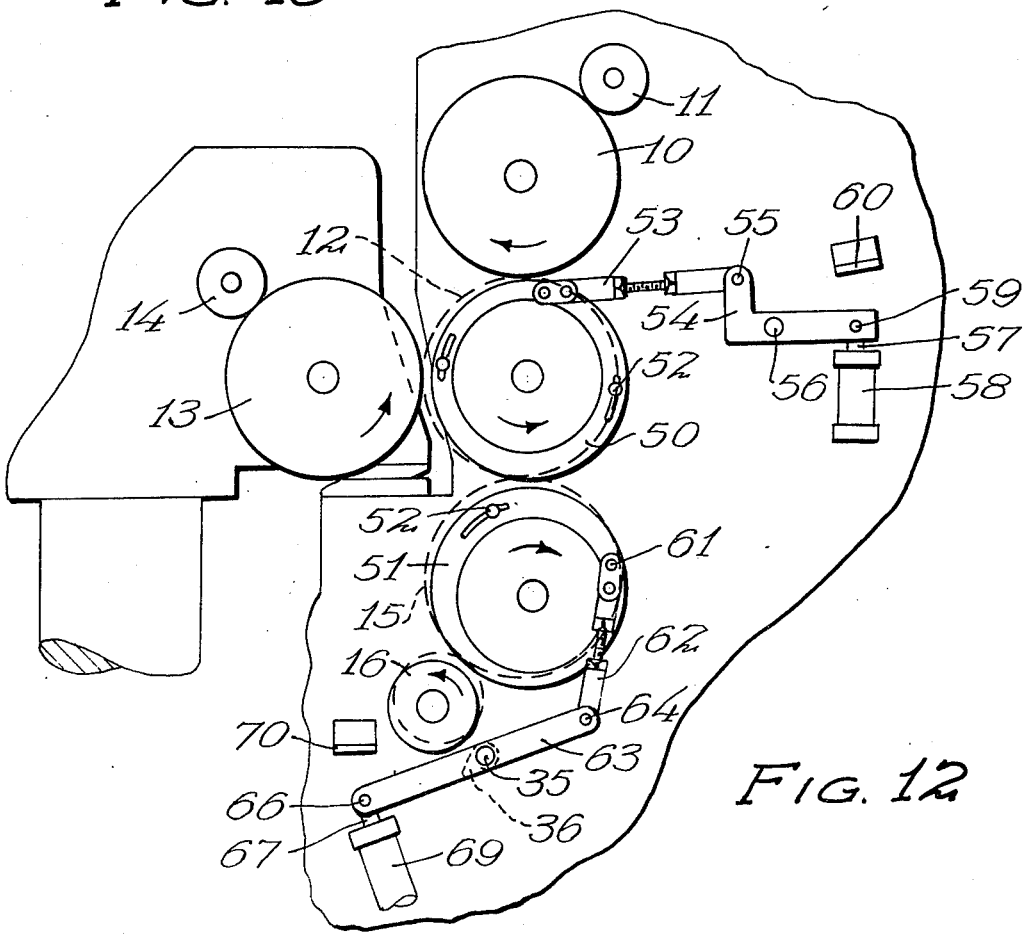
FIG. 12 shows the cylinder disengagement mechanism.

The adjustment of distance between rollers 10, 12, and 15, as well as the second color plate 13, is accomplished by means of eccentric cams 50 and 51 which are shown in FIG. 12. Rollers 12 and 15 are fastened to cams 50 and 51 by means of suitable set screws 52. By proper rotation of the eccentric cams 50 and 51, the desired contact may be obtained. Adjustment of cam 50 is accomplished by a tie rod 53 secured at one end to the cam 50, and at the other end to a bell crank lever 54 as indicated at 55. The bell crank lever 54 is pivoted about a pivot 56 by a rod 57 from an actuator 58 connected to the lever 54 at 59. The numeral 60 indicates a stop which limits the movement of the lever 54. In a similar manner cam 51 is rotated by tie rod 62 connected to a lever 63 as indicated at 64. The lever 63 is pivoted on shaft 35. Lever 63 is connected at 66 to a rod 67 operating from an actuator 69. Numeral 70 indicates a stop limiting the movement of lever 63.

When it is desired to disengage the cylinders from each other, the actuators 58 and 69 are actuated to disengage contact between the cylinders and discontinue any printing. At the same time, lever 63 rotates cam shaft 35 and cams 36 to move bracket 27 and the perfector rollers carried thereby away from impression cylinder 15. If desired this disengagement may be automatically controlled by optical sensors or microswitches positioned to detect improper stock feed or jam ups.

Figure 13:
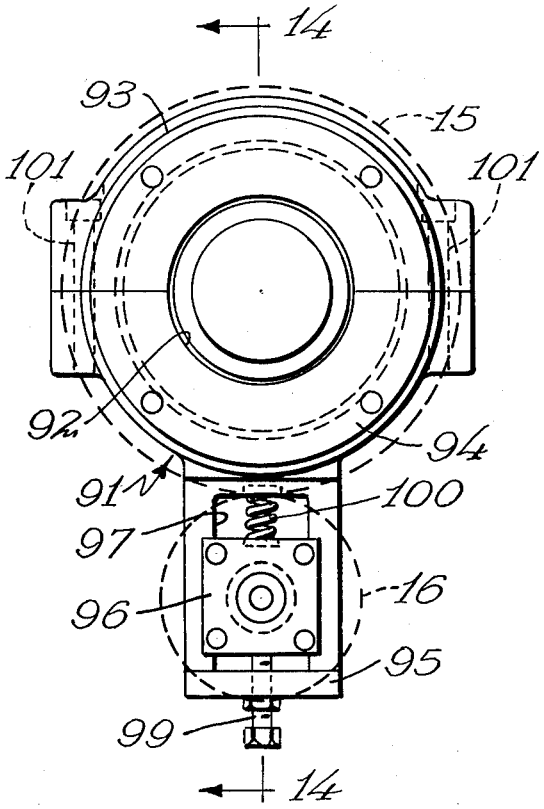
FIG. 13 discloses an alternative embodiment for mounting the perfector cylinder.
Figure 14:
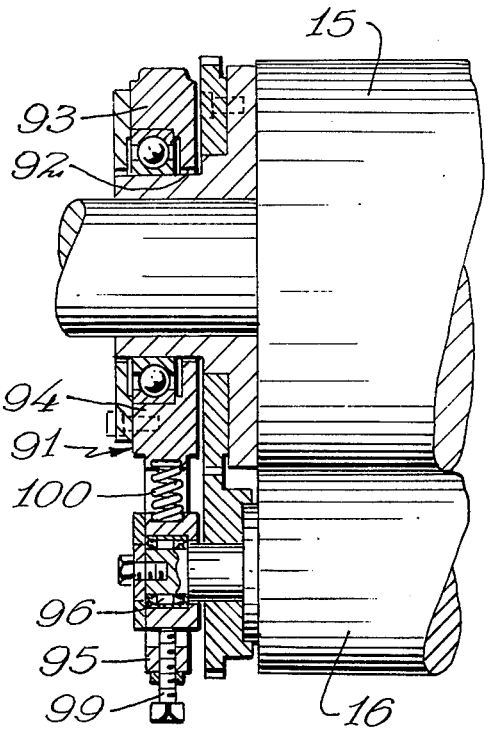
FIG. 14 is a sectional side view of the embodiment of FIG. 13 taken along line 14—14 in FIG. 13.

FIGS. 13 and 14 show a modified form of construction wherein the perfector roller 16 is carried on the impression roller 15 by a yoke 91 which allows the perfector roller to rotate about the impression roller to any desired position for ease of accessibility and maintenance. Yoke 91 pivots about the stub shaft at the end of cylinder 15 so that the perfector to impression cylinder distance remains constant. A circular aperture 92 is formed by two parts 93 and 94 held together by bolts 101 and having a projecting frame 95 in the form of a slide which support a bearing 96 which carries the perfector roller 16. Bearing member 96 is slideable in a rectangular aperture 97 and positioned by a set screw 99 and a spring 100. If desired one may also position another spring between bearing member 96 and set screw 99 so as to spring load the perfector roller against the impression roller to accomodate jam ups as described earlier.

Figure 15:
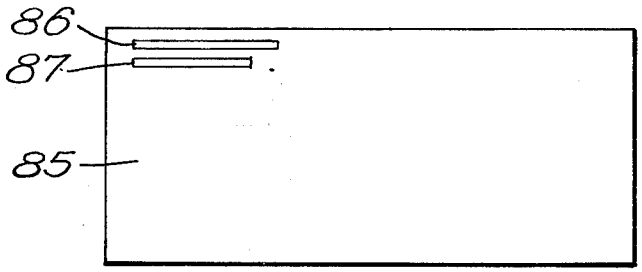
FIGS. 15 and 16 are plan views of the front and rear of an envelope showing typical areas of printing.
Figure 16:
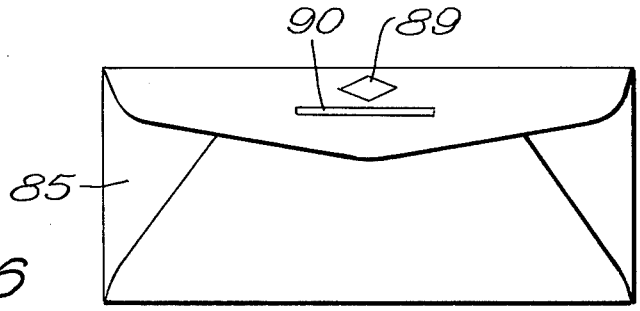

The printing press which has been described has been normally used for printing envelopes such as envelope 85 in FIGS. 15 and 16 in one or two colors. For example, the front face indicated in FIG. 15 shows an area 86 which could be one color, and an area 87 which could be a different color. In the same manner, the back of the envelope may be printed with one area 89 of one color and a second area 90 of a different color. Thus, the press is capable of printing a plurality of colors on either or both sides of the item making it very versatile in the printing field. Clearly, many structural modifications may be made to the apparatus described within the spirit and scope of the invention as defined solely by the appended claims.

I claim:

1. A perfector printing press comprising:

a frame having generally parallel opposite sides;

a blanket roller mounted between said frame sides and having a first circumference;

at least one plate cylinder and ink supply system mounted between said frame sides, adapted to make continuous rolling contact during the entire normal operation of the press with said blanket cylinder, said plate cylinder having said first circumference and plate means thereon adapted to produce alternate direct printing and transfer printing images;

an impression cylinder of said first circumference mounted between said frame sides and adapted to make continuous rolling contact during the entire normal operation of the press with said blanket roller to allow said direct printing image to be printed on one side of stock passing through a printing area between the blanket roller and the impression cylinder, at least part of said impression cylinder having a blanket thereon to pick up said transfer printing image from the blanket roller when no stock is passing through the printing area; and a perfector roller mounted between the frame sides in bearings and adapted to make continuous rolling contact during the entire normal operation of the press with said impression cylinder so as to transfer the transfer printing image from its location on the impression cylinder to an adjacent location on said impression cylinder positioned correctly to print on the other side of the stock passing through the printing area, said bearings carried in a mounting yoke which surrounds the rotational axis of the impression cylinder so as to permit movement of said perfector roller about the rotational axis of said impression roller in contact therwith.

2. The press of claim 1 in which said perfector roller is springably mounted against said impression cylinder so as to be springable away from the impression cylinder in the event of jam ups.

3. The press of claim 2 in which said perfector roller is mounted generally under the impression roller but up toward the stock exit side of the impression cylinder to permit easy access thereto and said blanket roller is mounted generally above said impression cylinder.

4. The press of claim 1 including cam means to move said perfector roller out of contact with said impression cylinder.

5. The press of claim 3 including cam means to move said perfector roller out of contact with said impression cylinder.

* * * * *